US006183684B1

(12) United States Patent
Lu

(10) Patent No.: US 6,183,684 B1
(45) Date of Patent: Feb. 6, 2001

(54) APPARATUS AND METHOD FOR PRODUCING NON-WOVEN WEBS WITH HIGH FILAMENT VELOCITY

(75) Inventor: Fumin Lu, Tamarac, FL (US)

(73) Assignee: Ason Engineering, Ltd., Fort Lauderdale, FL (US)

( * ) Notice: Under 35 U.S.C. 154(b), the term of this patent shall be extended for 0 days.

(21) Appl. No.: 09/280,033

(22) Filed: Mar. 26, 1999

Related U.S. Application Data

(60) Continuation-in-part of application No. 08/899,381, filed on Jul. 23, 1997, which is a division of application No. 08/617,023, filed on Mar. 18, 1996, now Pat. No. 5,688,468, which is a continuation-in-part of application No. 08/356,738, filed on Dec. 15, 1994, now Pat. No. 5,545,371.

(51) Int. Cl.[7] ..... B29C 55/30

(52) U.S. Cl. ..... 264/555; 264/103; 264/210.8; 264/211.14; 425/66; 425/464

(58) Field of Search ..... 425/66, 72.2, 464; 264/210.1, 210.8, 211.14, 555, 103; 65/538

(56) References Cited

U.S. PATENT DOCUMENTS 3,655,862 * 4/1972 Dorschner et al. ..... 264/210.8
3,695,858 * 10/1972 Russell ..... 65/538
3,802,817 * 4/1974 Matsuki et al. ..... 425/66
3,945,815 * 3/1976 Schmidt ..... 425/66
5,292,239 * 3/1994 Zeldin et al. ..... 425/66
5,976,431 * 11/1999 Mears ..... 264/40.1

* cited by examiner

*Primary Examiner*—David A. Simmons
*Assistant Examiner*—Robert A. Hopkins
(74) *Attorney, Agent, or Firm*—Malin, Haley & DiMaggio, P.A.

(57) ABSTRACT

An apparatus for producing a non-woven polymeric fabric web, such as a spunbond web, having filaments of 0.1 to 5 or higher denier with equivalent production rates is provided. A plurality of continuous polymeric filaments are extruded from an extruder and attenuated by a drawing unit that includes a longitudinal elongated slot strategically positioned at an optimum distance very close to the spinneret to increase the filament velocity by reducing air viscous drag on filaments and a drawing unit slot having a lower slot length of approximately 210 mm or less to increase form drag. A web forming table is positioned below the drawing unit for collecting the filaments and forming the filaments into a non-woven fabric web. Filaments of increased tensile strength are created by stress-induced crystallization resulting from higher filament velocity due to increased force on the filaments with less air viscous drag between the filaments and air streams.

21 Claims, 9 Drawing Sheets

Fig. 7 ADJUSTABLE PLATFORM FOR EXTRUDERS AND SPINBEAM, ADJUSTABLE ASPIRATOR ASSEMBLY AND FIXED WEBFORMER.

Fig. 8 FIXED PLATFORM FOR EXTRUDERS, ADJUSTABLE SPINBEAM, ADJUSTABLE ASPIRATOR ASSEMBLY AND FIXED WEBFORMER.

APPARATUS AND METHOD FOR PRODUCING NON-WOVEN WEBS WITH HIGH FILAMENT VELOCITY

This application is a continuation-in-part of application Ser. No. 08/899,381 filed Jul. 23, 1997 which is a division of application Ser. No. 08/617,023, filed Mar. 18, 1996, now U.S. Pat. No. 5,688,468 which is a continuation-in-part of application Ser. No. 08/356,738, filed Dec. 15, 1994, now U.S. Pat. No. 5,545,371.

BACKGROUND OF THE INVENTION

1. Field of the Invention

This invention relates generally to an apparatus, process, and the product produced therefrom for constructing a spunbond, non-woven web from thermoplastic polymers producing filaments of reduced diameter and improved uniformity at an increased production rate, and specifically, to an apparatus and process for heating and extruding thermoplastic materials through a spinneret, forming filaments of desired deniers by strategically positioning the drawing unit below the spinneret at a critical distance to increase filament velocity by reducing filament air drag and increasing form drag on the filaments by selective drawing unit slot length and air turbulence below the drawing unit slot to produce a filament of a desired diameter and molecular orientation and at an improved production rate, and the resultant spunbond product. A water spray for cooling may also be employed.

2. Description of the Prior Art

Devices for producing non-woven thermoplastic fabric webs from extruded polymers through a spinneret that form a vertically oriented curtain with downward advancing filaments and air quenching the filaments in conjunction with a suction-type drawing or attenuating air slot are well known in the art. U.S. Pat. No. 5,292,239 discloses a device that reduces significant turbulence in the airflow to uniformly and consistently apply the drawing force to the filaments, which results in a uniform and predictable draw of the filaments. U.S. Pat. No. 3,802,817 discloses a sucker apparatus positioned in a selected distance below the spinneret using jet streams having velocity in the range of turbulent flow to produce fine non-woven fleeces. U.S. Pat. No. 4,064,605 and European Patent Application No. 0230541 disclose examples of the formation of non-woven fabrics.

Conventionally, thermoplastic polymers such as polypropylene, polyethylene, polyester, nylon, and blends thereof are utilized. In the first step, the polymer is melted and extruded through a spinneret to form the vertically oriented curtain of downwardly advancing filaments. The filaments are then passed through the quench chamber where they are cooled down by chilled air, reaching a temperature at which the crystallization of the filament starts, resulting in the solidification of the filaments. A drawing unit located in a fixed position below the quench chamber acts as a suction having an air slot where compressed air is introduced into the slot creating a downward force on the filaments in the slot, and a rapidly moving downstream of air in the slot. This air stream creates a drawing force on the filaments, causing them to be attenuated or stretched above the drawing unit and exit the bottom of the slot where the filaments are deposited on a moving conveyor belt to form a continuous web of the filaments. The filaments of the web are then joined to each other through conventional techniques.

Providing for conventional construction of the filaments, typically filaments of 1.5 to 6 deniers or higher were produced. Using conventional methods, the hot filaments leaving the spinneret typically were immediately cooled to ambient temperature and solidified and then subjected to the drawing unit. According to a prior proposal, when the length of the filament traveling through the air is shorter than a specified value selected based on the throughput (gram per hole per minute) used, the extruded filaments will contact with a solid constituent of the drawing unit in advance of solidification of the filaments, resulting in development of filament breakage or damage. In other words, even though the prior art produces suitable non-woven webs, their production is limited by the ability to cool down and solidify the filaments in a predetermined length at appropriate throughput. The filament spinning speed reached in the prior art is in the range of 3,000 to 3,500 meters per minute.

Although the conventional method and apparatus produce suitable non-woven webs, the final product could be greatly improved and better fabric can be produced for any given polymer consisting of lower denier filaments. A thinner filament for any given throughput produces more surface area and more length per unit weight. A polypropylene spunbonded fabric with filaments of 0.1 to 5.0 or higher deniers would be desirable.

It is also desirable that a uniformity of filament denier and tensile properties be consistent so that the resulting fabric web has a uniform quality. Applicant has also determined that stress-induced crystallization in the spinning process (before solidification by cool-down) results in a stronger, higher tensile strength filament. The present invention provides for a higher rate of stress-induced crystallization.

Examples of end uses for the fabric web could be but are not limited to filtration materials, diaper covers and medical and personal hygiene products requiring liquid vapor barriers that are breathable and have air permeability.

With the present invention, a process for producing a superior quality non-woven web at much higher production and lower cost can be achieved. The core of the invention is to create an optimum situation wherein a much higher filament velocity (compared with that of conventional technologies) is achieved by selecting a minimum distance from the spinneret to the drawing unit based on the operating variables determined by such basic factors as the materials processed, the filament denier required, the throughput used, therefore resulting in a reduced air viscous friction drag associated with the length of filaments traveling with high velocity between the spinneret and the drawing unit and hence a reduced spin line tension, coupled with a higher drawing force created by the drawing unit with an optimal short slot vertical length to maximize the combination of the forces in terms of both the friction drag between air stream and filaments within the slot and the form drag underneath the slot.

The fiber velocity in the spunbond process is ultimately determined by the spin line force balance which, in the case of high speed spinning, can be reduced to the equation as follows:

$$F_{ext}=F_{inert}+F_{drag}$$

The force $F_{ext}$ is the external inert force pulling down the filaments. The force $F_{inert}$ is the inertia force which opposes the acceleration of the filaments and the force $F_{drag}$ is the air resistance produced by skin friction of the filaments traveling with high velocity in the air. Based on the spin line force balance, there are two ways to increase the filament spinning speed, that is, by increasing the force $F_{ext}$ and/or decreasing the force $F_{drag}$. The force $F_{drag}$ is linearly proportional to the length of the spin line, therefore shortening the distance between the spinneret and the drawing unit will reduce the air resistance accordingly.

As to the $F_{ext}$, unlike the fiber production where the $F_{ext}$ is supplied by a mechanical take-up reel or bobbin, the downward pulling force in the spunbond process on the filaments is created by the drawing unit which employs one or more streams of high velocity air directed downwardly inside the drawing unit slot in the direction of filament travel and interaction between the air stream generated inside the drawing unit and in accordance with the invention, the air flow below the drawing unit and the filaments. There are two types of such interaction: The first type arises from the viscous friction resulting from the differences in velocity between the filaments within the drawing unit and the drawing unit air stream in that the air stream with higher velocity pulls the filaments of slower speed downwardly. Therefore, the filament speed will always be lower than that of the air stream. The pull frictional force by viscous friction has almost a linear relationship with the generated air stream nozzle air velocity. The second type is the so-called "form" drag caused by the filaments "flapping" or "waving" in the airflow field below the drawing unit. It is very clear from the discussion above that the effectiveness of the draw unit (air gun or slot) in terms of affecting the filament velocity reached in the spunbond process depends strongly on the way the drawing unit produces the drag force.

The short draw slot used in the present invention is the most effective one producing the maximum drag force by utilizing an optimum combination of creating viscous friction drag within the drawing unit slot and the "form" drag underneath the slot.

The increased net drawing force not only produces thinner filaments at higher filament spinning speed, but also creates a stronger stress-induced crystallization effect, causing the on-line crystallization of filaments to occur earlier along the spinline at higher temperature and rate. Correspondingly, the filaments are solidified earlier at higher temperature, thereby resulting in less quench capacity needed or a higher mass throughput that can be used with the same quench capacity. Up to 90 to 95 percent reduction of the air drag associated with the length of filaments between the drawing unit and the spinneret can be achieved by moving the drawing unit from a conventional distance of 3 to 5 meters from the spinneret to 0.05 to 1.5 meters, giving rise to the possibility of producing finer filaments at a higher production rate. For the coarse denier filaments (5 to 20), the distance should be larger (up to 1.5 meters) than for fine deniers (0.1–5) best achieved in a range of 0.2 to 0.9 meters. By determining the most efficient filament distance between the spinneret and the drawing unit, the diameter of the filaments can be controlled in such a way that sticking among filaments in contact can be avoided, the temperature of the filaments remains as high as possible before the filaments enter the drawing unit, reducing the viscosity of the filaments being drawn and consequently facilitating the attenuation of the filament, resulting in filaments having much smaller diameters. The distance between the web forming table and the drawing unit can also be adjusted in order to form a non-woven web which has desired uniformity with other mechanical properties.

A quench chamber is normally used to initially cool the filaments. A water mist or atomized water spray may be added for cooling and interacting in the process to improve the filament uniformity and production. The water mist improves the process, but the basic apparatus and process will work without the water mist solely by the reduced separation of the spinneret and the drawing unit, with cooling air as a quench.

In terms of filament spinning speed, 4500 meters per minute for polyethylene terephthalate (PET) and 3500 meters per minute for polypropylene (PP) are achievable in the prior art and in commercial production today. With the Applicant's invention, Applicant believes that 6000–8000 or more meters per minute for PET and 4500–6500 or more meters per minute for PP have been achieved. Applicant has been able to produce filaments (5 to 10 microns at spunbond production rates 70 to 150 Kg/H/M width), which is far beyond the capability of conventional production technology.

Although it is advantageous to provide the machine with the adjustability of the distance between the spinneret and the draw unit so that the maximum filament velocity for a given material such as polypropylene or polyester and a given throughput and filament denier can be readily obtained with adjusting of the draw unit to an optimum distance to the spinneret, it is highly possible that for a fixed product in terms of material processed and filament denier required, an optimum machine setup and processing conditions can be predetermined to produce the desired product with maximum filament velocity, resulting in the fact that the machine's adjustability of the distance between the spinneret and the draw unit will no longer be necessary.

A stable process can be obtained wherein 4.5 denier PET filaments are produced at 4.0 ghm with the drawing unit positioned at an optimum distance from the spinneret using 75 psig of air pressure. Applicant has found that Applicant can use fixed distances between 5 and 150 cm and optimally between 20 to 90 cm separation for fine deniers (0.1–5) and up to 150 cm for coarse deniers (5–20) between the spinneret and the drawing unit.

There are two distinct changes occurring for the on-line diameter profile as the filament spinning velocity increases. First, the rate of reduction in diameter of the melt thread in the upper region of the spinline increases. In other words, the melt thread is thinning much faster at a higher spinning speed, creating more surface area to be cooled. Secondly, the invention improves the position where the filament starts to solidify due to the stress-induced crystallization effect, which moves up the solidification point towards the spinneret. The higher the filament speed, the less the cooling is needed (shorter quench chamber). The drawing unit can be permanently positioned closer along the spinline without causing interruption of the process because the filaments are well solidified before entering the slot of the drawing unit where contacts among filaments are made. Because the distance between the spinneret and the drawing unit is decreased, the drag force $F_{drag}$, which is associated with the length of filaments (dZ) traveling at high speed between spinneret and drawing unit will proportionally be reduced, resulting in increasing inertial force $F_{inert}$, which leads to even higher filament speed, further thinner filaments and higher solidifying temperature. This in turn allows the drawing unit to be positioned at an optimum minimal distance to the spinneret for minimum viscous air drag for a given filament material and desired denier. Applicant's results show that depending on the material to be processed and the throughput (gram per hole per minute, referred to as ghm from now on) to be used, the drawing unit can be as close as 5 to 90 cm for fine deniers (0.1 to 5.0) and up to 150 cm for coarse deniers (5–20) to the spinneret at a throughput of up to 4 ghm or more, compared with 3 to 5 meters being used in commercial production today. Thus up to 90 to 95 percent of reduction in spinline length is achieved with significant improvement on-the output of the process in terms of fineness of filaments that can be produced at a given production rate. The closer the drawing unit to the spinneret, the higher the temperature at which filaments are being drawn hence the lower the elongational viscosity will be, which is inversely proportional to the elongation rate. That is, with lower elongational viscosity, higher elongation rate (higher filament speed) can be achieved under the same drawing force.

SUMMARY OF THE INVENTION

The present invention also includes an improvement in the drawing unit and in particular in the drawing unit slot which receives the filaments therethrough providing the drawing force on the filaments. With the viscous air resistance being reduced by minimizing or reducing the distance between the spinneret and the drawing unit allowing for increased velocity of the filaments, the amount of force exerted on the filaments will determine the filament velocity accordingly. However, using the present invention, Applicant provides an improved drawing unit slot within which the distance between the slot wall openings for the compressed air nozzles and the base or exit of the slot is less than 210 millimeters which results in an increased drawing force on the filaments after the filaments exit the slot base opening causing the filaments to wag and move back and forth laterally almost in an undulating S-like motion, greatly increasing the drawing force downwardly on the filaments resulting in a much higher velocity of the filaments. Because the distance between the nozzles and the base opening has been greatly reduced and is less than 210 millimeters, the end result is that the air streams exiting from the slot still possess very high speed and momentum interacting with filaments to create the "flapping' or "waving" movement of the filaments producing the enhanced form drag. The form drag created by Applicant's improved slot opening and slot length thus increases the force on the filaments enhancing and increasing the ultimate velocity of the filaments through the slot. In the prior art slots, the objective was to not create turbulence and to have exceptionally long slot distances vertically to prevent turbulence and maximize the viscous component of $F_{ext}$ within the drawing unit, and therefore, by the time the air streams reached the base of the slot, there was virtually no turbulence, which was the goal. Applicant has found that the turbulence is beneficial resulting in form drag on the filaments, thereby enhancing the force increasing the velocity. As stated above, by increasing the velocity, the stress-induced crystallization effect, will correspondingly result in a higher rate of crystallization and an improved filament of enhanced tensile strength and decreased denier per filament at any given throughput.

A process and apparatus for producing a spunbond, non-woven web composed of filaments of increased tensile strength and improved uniformity from thermoplastic materials at an increased production rate, comprising a melt spinning machine having an extruder for heating and extruding thermoplastic materials through a spinneret, forming substantially a plurality of vertically oriented polymeric filaments and a filament drawing unit having a longitudinal elongated slot substantially equal in length to the spinneret, said drawing unit being strategically positioned below the spinneret at an optimum distance to receive the filaments therein to minimize viscous air drag to increase filament velocity. The drawing unit may be fixed or movably connected to the spinneret and can be manually or by motor moved to a desired distance from the spinneret before and/or during the initial first-time setup of the machine to produce spunbond filaments. The distance between the elongated slot of the drawing unit and the spinneret is critically determined to produce filaments with high spinning speed resulting in finer filaments with an improved tensile strength being obtained at an improved production rate. The important operational distances to reduce filament air viscous drag for increased velocity between the drawing unit and the base of the spinneret (where the plastic materials are extruded) is substantially between 0.05–0.9 meters for fine denier and up to 1.5 meters for coarse denier, depending on the materials processed and the denier desired. By locating the drawing unit relatively close to the base of the spinneret an improved tensile strength filament is obtained because the drawing process happens as the hot molten filaments exit the spinneret, which allow them to be cooled enough not to stick together while simultaneously being hot (soft) enough to be drawn into a finer, more uniform denier filament with the effect of stress-induced crystallization causing filaments being produced with higher molecular orientation and crystallinity and greater tensile strength. In conventional devices where there is a large space between the base of the spinneret and the drawing unit, typically the hot molten threads are first cooled to ambient temperature and solidified before reaching the drawing unit where it is more difficult to achieve the type of finer or thinner filaments that are obtained from the present invention. The filaments, when hot, can be stretched or attenuated to a finer and stronger filament using the present invention. The result is a better product because it has more surface area and length per unit weight and higher strength.

The drawing unit has a V-shaped slot along the upper portion with a horizontally directed elongated open end at the top and opposing side walls that depend from the open top end, towards each other, to form a narrow gap at the end of the upper portion of the slot. An adjacent nozzle that supplies a directed stream of air introduced into the slot along the entire length of the slot so that a turbulent flow pattern is formed in the area where two variable, directed air streams merge with each other. The slot also includes a bottom portion that is shaped to improve randomness of the spreading of filaments for uniformity of the resultant web. The vertical slot length from the air nozzles to the base opening is approximately 210 millimeters or less so that the internal air streams create exterior turbulence below the bottom opening of the drawing unit slot resulting in a high value of form drag on the filaments resulting in a greater overall drag force (drawing force) on the filaments increasing filament velocity and stress-reduced crystallization.

A web forming table is positioned below the drawing unit to receive the sheet of filaments, forming the same into a non-woven web.

The machine is constructed such that the position and location of the drawing unit and the web forming table and the drawing unit and spinneret can each be independently adjusted vertically along the spin line, as well as horizontally perpendicular to the spin line.

The drawing unit includes two air supply nozzles communicating with the drawing slot on both sides to form an angle of 10° to 30° each, each adapted to a air passageway for introducing a directed stream of air. In conventional drawing units, the vertical slot length from the air nozzles to the bottom of the slot (typically much greater than 210 mm) acts to reduce the air velocity surrounding the filaments as the filaments exit the drawing unit. Because of the relatively short slot vertical length (approximately 210 mm or less) in the present invention, a turbulent flow exhaust pattern is created when air streams exiting from both nozzles come together in contact with the filaments as well as each other so that an intensive "flapping" or "waving" motion of the filaments is established. This interaction of the air and filaments drastically increases the form drag force exerted on the filaments, resulting in increased attenuation of the filaments.

In order to operate a spunbond process and machine with the drawing unit positioned 0.05 to 0.9 meters from the spinneret as described before for fine deniers and up to 1.5 meters for coarse deniers, an initial startup procedure may be followed. In one embodiment, the process begins with the drawing unit positioned at least 100 cm or more away from the spinneret at an appropriate location and a reduced polymer throughput and nominal air pressure and volume are set such that the threading of the filaments through the slot of the drawing unit can be readily accomplished. Once the spinline at this condition is established, the air pressure and the throughput can be gradually increased while the drawing unit is moved toward the spinneret. Through this startup procedure and these adjustments of distance between the spinneret and drawing unit (which gets smaller), a stable throughput process can be obtained where the high quality filaments of high tensile strength can be produced at an equivalent or higher throughput. Therefore, once initial spinline threading is completed and the spin line stabilized, the drawing unit can then be raised manually or by motor gradually towards the spinneret while the polymer throughput and the air pressure are appropriately increased, an optimum position between the spinneret and drawing unit is reached where low viscous air drag on the spin line results in high filament velocity, hence fine filament (smallest denier) and uniformly improved web at the increased production rate.

In another embodiment, the start-up procedure could be altered so that once the desired distance between the spinneret and drawing unit was already determined (perhaps by trial and error) for a given polymer material such as polypropylene or polyester and a desired and optimum distance obtained for minimal air drag and maximum filament velocity, once the distances are fixed and optimally determined for a desired throughput and filament denier, then start-up could proceed from a fixed unit (no moveable distance between the spinneret and drawing unit). In this particular situation, obviously a start-up of slower filament velocity must be initially obtained with careful force applied initially before the desired filament velocity is achieved. The start-up in this case may be enhanced by providing for an initial expansion of the drawing unit slot (more open while threading the filaments) and getting the process started. In other words, additional space is provided in the drawing unit slot opening for a given amount of time in order to start the filaments through the slot. Applicant has determined, however, it is possible to operate at a desired throughput achieving maximum velocity of filaments with reduced air drag and increased form drag in accordance with the present invention using a fixed distance between the spinneret and drawing unit that has been predetermined to be the optimum minimal filament distance between the spinneret and the drawing unit to achieve the low air resistance friction drag on the filaments resulting in high velocity and high throughput. This also results in altering the onset of crystallization relative to the position and temperature change of the filaments so that additional stretching and stress-induced crystallization can be achieved between the spinneret and drawing unit on the filaments resulting in a much higher quality filament because of its enhanced crystalline structure.

It is an object of this invention to provide a machine that produces a spunbond, non-woven web comprised of filaments having a finer denier and an improved tensile strength at a higher production rate than conventionally produced filaments.

It is another object of this invention to produce a spunbond, non-woven web fabric comprised of thermoplastic filaments having an optimum small denier for creating non-woven web fabrics with more surface area and more length per unit weight.

And yet still another object of this invention is to provide a method for producing webs with better fabric uniformity from thermoplastic materials for use as spunbond, non-woven web at a higher production rate.

But yet still another object of this invention is to provide a method and machine that produces a spunbond, non-woven web comprised of filaments that can be produced using high velocity filaments resulting from reduced distance between the spinneret and drawing unit to reduce air resistance drag on the filaments and to reduce the vertical slot distance in the drawing unit to produce form drag below the drawing unit resulting in a higher drawing force. The end result is the production of filaments of a higher quality and structural integrity at a higher throughput.

In accordance with these and other objects which will become apparent hereinafter, the instant invention will now be described with particular reference to the accompanying drawings.

DESCRIPTION OF THE PREFERRED EMBODIMENT

Figure 1:
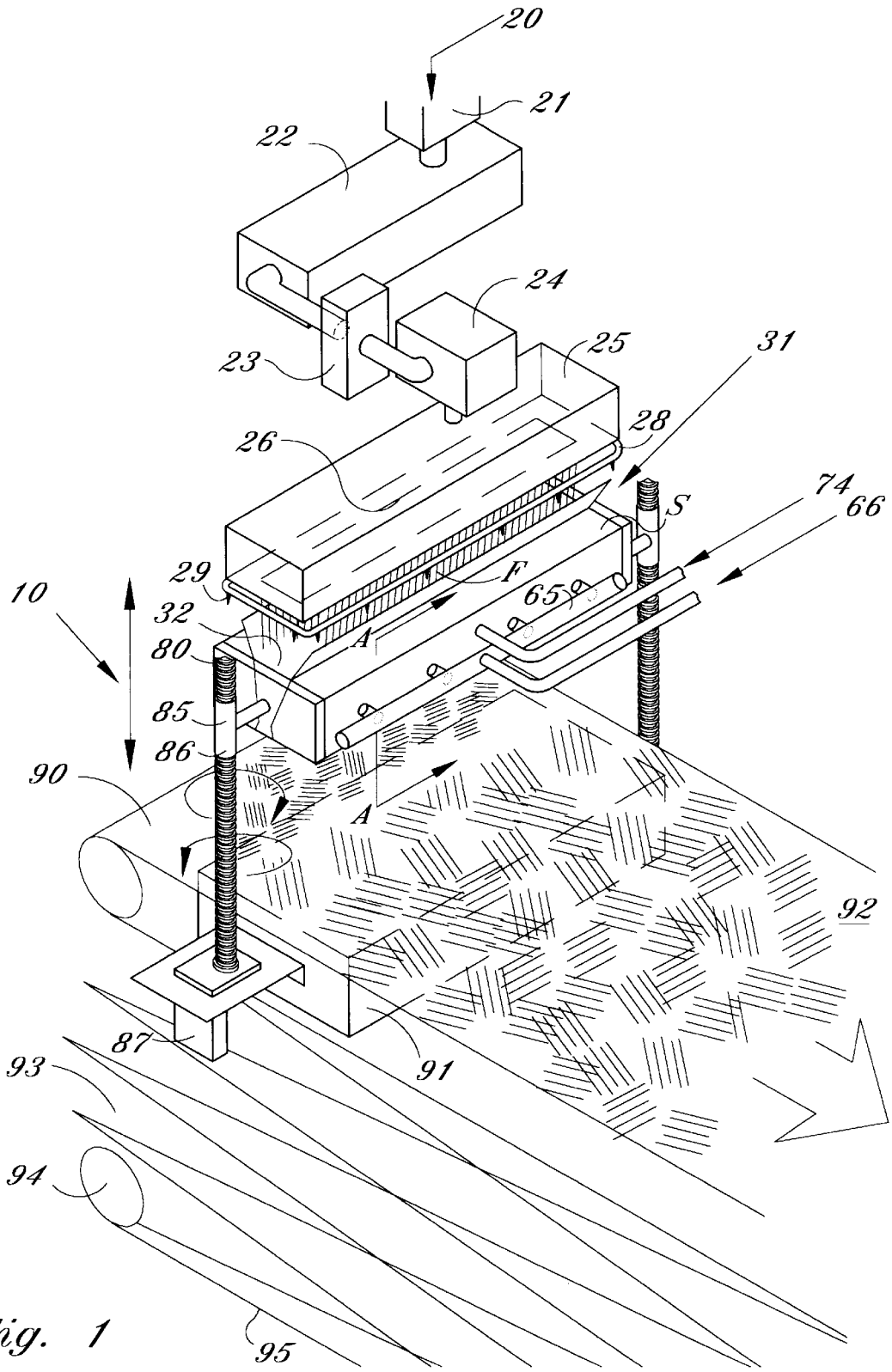
FIG. 1 shows a perspective view of the apparatus in accordance with the present invention.

Referring now to the drawings and in particular FIG. 1, the present invention is shown generally at 10 that includes an improved melt spinning machine that includes an extruder 22, spinbeam 25, and the drawing unit 31. The extruder 22 and spin beam 25 are fixedly mounted to a moveable floor support above the movable drawing unit 31.

The drawing unit 31 is movably supported above a movable mesh wire belt conveyor 92 that is a component of the web forming table 90. The web forming table further comprises an adjustable (vertically) base 93 which can be used to adjust vertically the distance between the top of the table 90 and the spinneret 26 in a range of about 30 to 150 cm. Wheels 94 under the base 93 are mounted on a pair of tracks 95 so that the web forming table 90 can be moved back and forth horizontally to allow certain space for changing of the spinneret 26.

Polymer is fed from polymer supply 20 into hopper 21 where the polymer is heated and melted in extruder 22, pushed through filter 23 and metering pump 24 to spin beam 25, where it is then extruded through a spinneret 26 having a plurality of multi-rowed orifices, together forming a curtain of vertically downwardly advancing filaments F.

The drawing unit 31, which acts to attenuate the filaments, includes an elongated longitudinal slot 32 which is strategically aligned below the spinneret to receive the curtain of filaments which are moved by gravity and air pressure. The most important distance with respect to filament size and throughput volume is the distance between the base of spinneret 26 and the top of the drawing unit 31. The filaments F, before being drawn by the drawing unit 31, are cooled and partially solidified by a fast moving stream of air (and optionally including atomized water) entrained by the suction of the drawing unit 31 of ambient air with mist produced by the water spray unit 28. Not shown in FIG. 1, a quench chamber can be mounted between the spinneret and the drawing unit 31 to cool the filaments.

Figure 2:
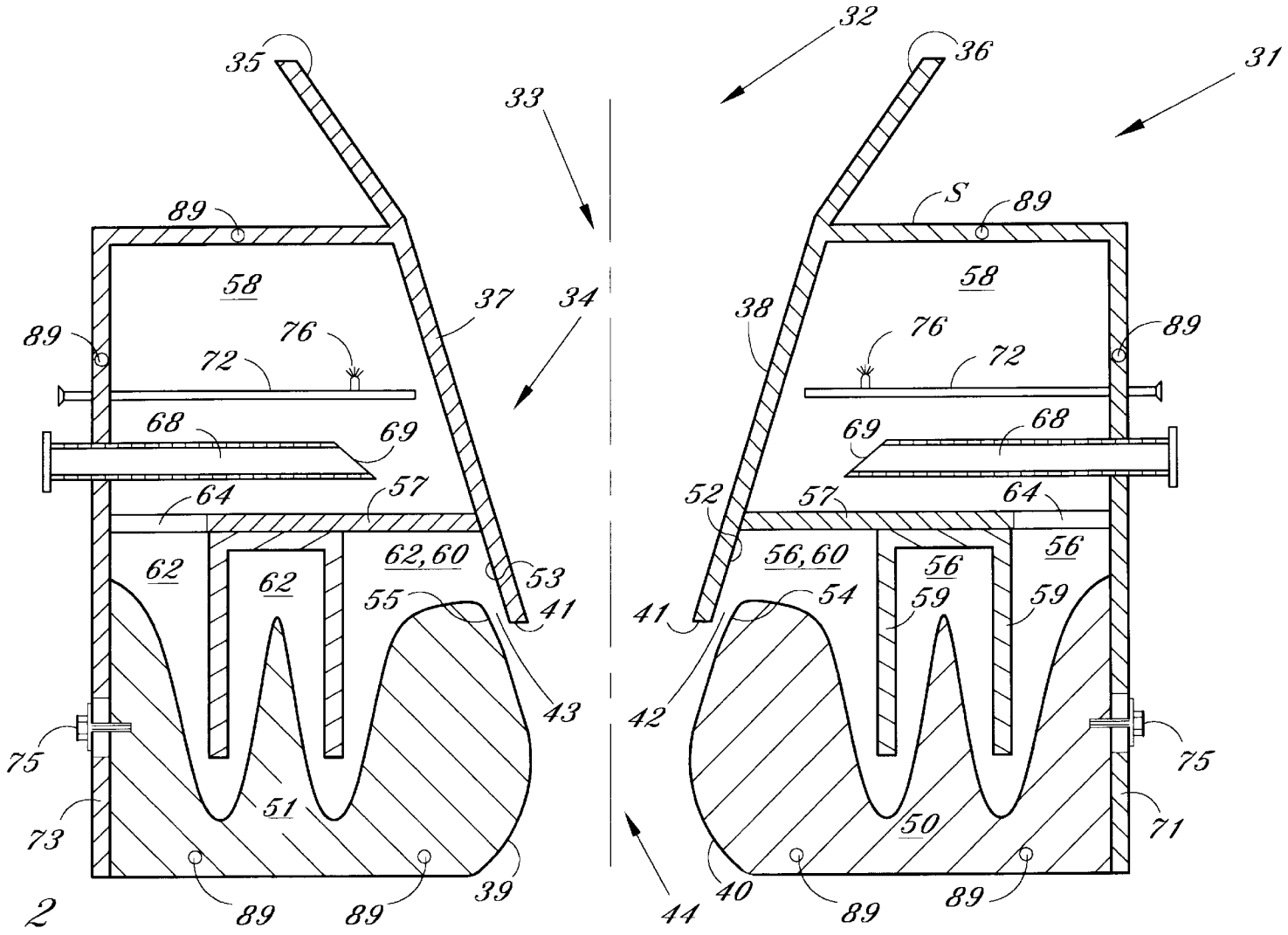
FIG. 2 shows a side elevational view of the drawing unit in cross section used in the present invention.

Referring now to FIG. 2, the drawing unit 31 includes slot 32 having a horizontally directed, elongated open top slot segment 33 that includes a pair of side walls 35 and 36 projecting from upper surface S of the drawing unit 31 at an angle of up to 90°. The drawing unit 31 also includes upper slot segment 34 comprised of a pair of side walls 37 and 38 which depend from the top slot segment 33 at an angle of substantially between 15° to 60° and preferably, 30° to 45°. The slot 32 further comprises a lower slot segment 44 having lower side walls of a pair of bottom blocks 50 and 51. Transverse shoulders 41 are positioned between the upper and lower slot segments 34 and 44 on each side of the slot 32. A pair of air nozzles 42 and 43 on each side of slot 32 extend along the entire longitudinal length of the slot 32 and are formed between inner surfaces of the lower end of the upper slot side walls 37 and 38 and the opposing surfaces 54 and 55 of bottom blocks 50 and 51.

An air passageway 56 extends along the entire longitudinal length of the slot 32 of drawing unit 31 and is defined by separation plate 57 at the bottom of air chamber 58, having two vertically sectional plates 59 attached, and a curved surface of bottom blocks 50 and 51. The air passageway 56 is divided into two segments, a discharge segment 60 connected with nozzles 42 and 43 having a gradually smoothly reducing width in the direction towards the associated nozzle and unifying segment 62 that contains four parallel vertical sections in an arcuately curved section between each pair of vertical sections. The unifying segment of the air passageway 62 is connected with the air chamber 58 through an air window 64 which is a brake plate placed at the edge of the separation plate 57 adjacent to side walls 70 and 71 of the drawing unit 31.

Air is fed to air chamber 58 through a manifold 65 connected to a suitable air supply unit 66 (see FIG. 1). The air chamber 58 comprises a number of air lines 68 coming into air chamber 58 from manifold 65 and having an open end 69 facing up and close to side walls 37 and 38 of the upper slot segment. The arcuately curved section of the air passageway and underlying segment creates an air pressure drop which serves to equalize the air volume flow rate and velocity along the entire longitudinal length of the slot 32, especially at the outlet of the nozzles 42 and 43. The area for the passage of air decreases gradually along the air passageway from air window 64, all the way to the outlet of the nozzles 42 and 43, which also serve to unify the air pressure. As a result, the airflow at the outlet of the nozzles 42 and 43 will be uniform in volume and velocity along the entire longitudinal length of slot 32.

The air chamber 58 further includes a number of water spray heads 76 (optional) installed and in fluid communication with water inlet pipe 72 connected to a water supply unit 74. The mist from the water spray heads serves to cool down the incoming air from the air supply unit 66, which facilitates the solidification of filaments contacting the air stream.

The bottom blocks 50 and 51 of the drawing unit are constructed in such a way that the upper surfaces of the blocks, which define the air passageway with the separation plates 57 and two vertical sectional plates 59, are composed of two downwardly arcuately curved and one upwardly arcuately curved edge. The two downwardly curved edges have different depths. The edge closer to the air window 64 is 2 to 10 mm longer than the other edge. The bottom blocks 50 and 51 of the drawing unit are connected with side walls 73 and 71 of the drawing unit by a plurality of bolts 75 through extended holes on the upside walls 71 and 73 so that the positions of the blocks can be adjusted up or down to change the gap of the nozzles 42 and 43 and therefore the volume and velocity of air flow according to the needs of the process.

Applicant has determined that the vertical length of the drawing unit slot defined between slot ends 41 down to the very bottom of the slot defined by walls 39 and 40 greatly affects the amount of form drag on the filaments after they exit the very bottom of the slot. Applicant has determined that the slot length between the slot wall ends 41 defining the slot opening and the bottom most edges of the slot defined by walls 39 and 40 should not exceed 210 mm.

Vertical slot lengths found in conventional spunbond machines greatly exceed 210 mm. The result is that the air under pressure exiting the nozzles that acts as the drawing force on the filaments within the slot is expended in velocity and pressure because of the length of the vertical slot. With the present invention, by limiting the slot vertical length from air nozzle to base opening to 210 mm or less, sufficient velocity and momentum of air is experienced beneath the slot opening that causes extreme form drag on the filaments as they extend beyond the end of the slot bottom causing them to undulate in an S-like pattern due to the turbulence of the air pressure greatly increasing the drawing force in form drag which in turn greatly increases the velocity of the filaments as they pass through the slot.

The Applicant believes that there is a synergistic effect in reducing the size of the vertical slot distance in the drawing unit in conjunction with reducing the distance between the spinneret and the drawing unit upper slot opening which reduces the air resistance drag on the filaments thereby allowing for increased velocity of the filaments.

Figure 3:
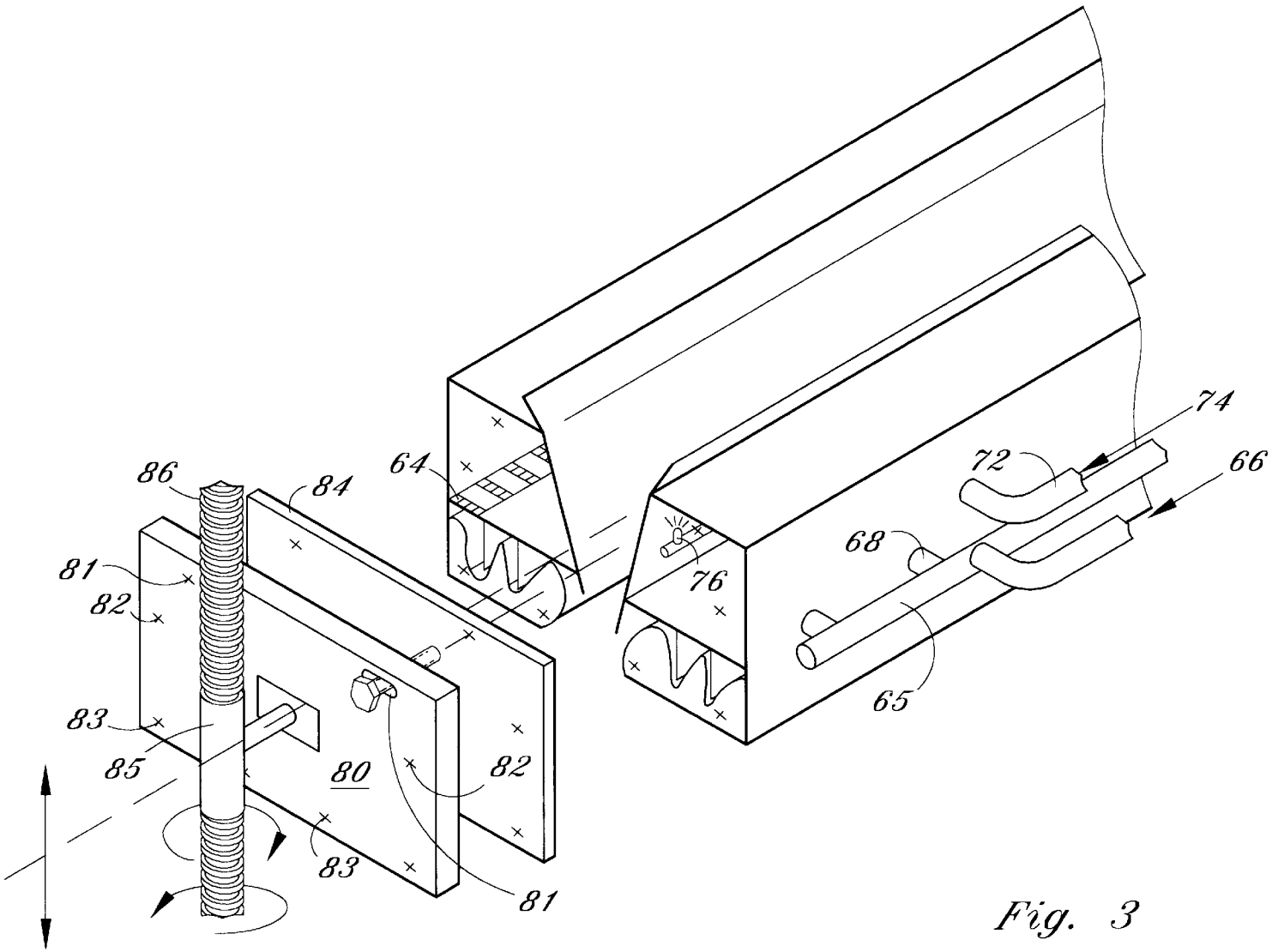
FIG. 3 shows an exploded perspective view showing a drawing unit in accordance with the present invention.

Referring now to FIG. 3, the drawing unit 31 includes on each side the side cover plate 80 connected by a number of bolts 89 through horizontally corresponding extended holes 81, 82, and 83, through which the width of the slots 34 and 44 can be adjusted. A rubber gasket 84 is used between the body of the drawing unit 31 and the side cover plate to seal the unit. The distance between the drawing unit 31 and the web forming table 90 can be adjusted with male screws 86 vertically attached to the side cover plate 80 through matching female screws 85 and driven by a motor with a gear box system 87 attached to the web forming table 90 (see FIG. 1). By turning screws 86, the position of the drawing unit 31 relative to the web forming table 90 can be correspondingly adjusted. FIG. 3 also shows the air supply 66 and water supply conduit 74 attached to input conduits 65, 68, and 72, respectively.

Referring back to FIG. 1, a very important element of the invention is shown. The web forming table 90 is positioned below the slot 32 of the drawing unit 31 to receive filaments F and form the filaments into a non-woven web. The web forming table 90 comprises a vacuum suction box for pulling down filaments onto a moving mesh wire belt conveyor 92 which transports the as-formed web to the next stage of the process for strengthening the web by conventional techniques to produce the final non-woven fabric web. The web forming table 90 includes the adjustable base 93 which is used to adjust vertically the vertical distance between the top of the table 90 and the spinneret 26.

The distance between the drawing unit 31 (along the top slot 32) and the lower portion or surface of the spinneret 26 is a critical factor for accomplishing the invention. The distance between the bottom of the spinneret and the top of the drawing unit can be adjusted, preferably between 5 to 90 cm for fine denier (0.1–5) and up to 150 cm for coarse denier (5–20) during normal production to produce an optimum high filament velocity resulting from low air resistance for a particular polymer, denier and throughput. Once the optimum distance is determined for a particular product, the spinneret/drawing unit distance can remain fixed. The following is an example of an apparatus constructed in accordance with the present invention using polypropylene as the polymer.

EXAMPLE 1

A startup procedure is desirous in one embodiment in order to efficiently establish optimum conditions to obtain the highest filament spinning speed at a desired corresponding throughput. Therefore, at initial startup, the distance from the top of the drawing unit to the spinneret may be in a conventional range of up to 150 cm separation distance or greater. A lower throughput, less than 1.0 ghm, at a lower air pressure of typically 10 to 20 psig, is established so that threading of the filaments through the drawing unit slot can easily be accomplished. Once the continuous filament spinline at these conditions is established, the air pressure in the drawing unit is gradually increased, which increases the spinning speed. The drawing unit could be positioned closer to the spinneret, (at the same time) adjusting the throughput and the air pressure accordingly.

The final distance from the top of the drawing unit to the spinneret may be from 5 cm to 150 cm, preferably 20 to 90 cm, during normal production based on the desired product and filament velocity. The longer the filament distance between the spinneret and the drawing unit, the more air resistance drag on the filaments which opposes the filament velocity. The width at the top of top slot segment 33 of the drawing unit is about 10 to 20 cm. The width at the top of the upper slot segment 34 is about 5 to 15 cm. The width between the opposing edges of slot 32 at shoulder 41 is about 0.3 to 2.0 cm. The gap of the outlet of nozzles 42,43 is about 0.1 to 0.6 mm. The air streams introduced from air supply unit 66 on both sides of the slot have a velocity of about 100 to 350 m/sec at the exit of the outlet of nozzles 42,43 and form a turbulent flow as they merge. Air and mist forces are generated by the air streams exiting from nozzles 42,43 and exert a pulling force on the filaments. The vertical slot distance in the drawing unit from the air nozzles 42, 43 to the bottom of the slot is less than 210 mm. The filaments thus entrained form an intensive "flapping" or "waving" pattern when moving along with the air stream below the slot opening in compliance with the pattern of the airflow. It is this intensive "flapping" motion, coupled with the closeness of the drawing unit to the spinneret, that creates an optimum situation, wherein a significantly increased air drawing force produced by "form drag" due to the flapping motion is exerted on filaments that are still "hot" and therefore readily to be stretched, resulting in filaments having a denier o about 0.1 to 2.5 or higher for polypropylene at a production rate of about 70 to 360 kilograms per meter of machine width per beam, hereafter referred to as a dimension corresponding to the length of the spinneret, per hour and 0.1 to 4.5 deniers for polyethylene terephthalate at a production rate of about 100 to 540 or more kilograms per meter of machine width per beam per hour.

EXAMPLE 2

The length along the drawing axis at the top of the top slot segment 33 of the drawing unit is 10 cm. The width between the opposing halves at the top of upper slot segment 34 is 5 cm. The width between the opposing edges of slot 32 at shoulder 41 is 3 mm. The vertical slot distance from the air nozzles to the slot bottom walls 39 and 40 is less than 210 millimeters. The gap of the outlet of nozzles 42,43 is 0.1 mm.

The cross direction length of the spinneret is 10 cm. The number of holes on the spinneret is 144 with orifice diameter of 0.35 mm. The quench chamber located just beneath the spin beam is 15 by 28 (cm×cm), supplying chilled air of 45 of to 60° F. The raw material used is polypropylene 35 MFR. The processing temperature used is 230° C. The throughput used is 2.5 gram per hole per minute. The distance from the top of the drawing unit to the spinneret is 40 cm. The air supplied to the drawing unit is at 3.0 cubic meters per minute with pressure of 55 psig. The distance from the bottom of the drawing unit to the surface of the web forming table 90 is 40 cm. A uniform curtain of fine filaments is seen exiting from the slot of the drawing unit after being stretched by the downwardly turbulent air stream merged together by two air streams from both sides of the drawing unit. The non-woven fabric thus obtained has an excellent uniformity with filament size of 3.5 deniers. The filament spinning speed in this case is 6,400 meters per minute.

The processing may go through the startup procedures as follows. The initial polymer throughput is 0.5 gram per hole per minute. The drawing unit is positioned 150 cm below the spinneret. The air pressure of 15 psig for the drawing unit is used. Slight quench is supplied. The threading of filaments through the drawing unit under this condition is readily completed. Thereafter, the drawing unit is moved up gradually while the air pressure and the throughput are increased correspondingly and certain amount of quench air is then supplied until the final processing condition mentioned above is reached. It should be noted that there is a range of conditions under which the startup can be accomplished. The sole purpose of the startup is to thread the filaments through the slot of the drawing unit to establish a stable spinline. In other words, it is not practical to thread filaments extruded at a rate of 2.5 gram per hole per minute through a drawing unit positioned 40 cm below the spinneret without facing a problem of unsolidified filaments contacting the solid constituent of the drawing unit, causing severe blockage of the slot and the process has to be stopped. The final throughput and high filament velocity could be achieved without moving the spinneret relative to the drawing unit at or after startup once the desired most efficient filament distance has been established.

EXAMPLE 3

Using the same equipment setting as in Example 2 with the raw material being PET (polyethylene terephthalate). The processing temperature used is 290° C. As a startup, throughput of 0.5 gram per hole per minute is used and the drawing unit is positioned 25 cm from the spinneret. No quench air is needed. The air pressure of 20 psig with volume rate of 2.0 NM/min is supplied to the drawing unit. The threading of the filaments through the slot can be readily achieved. Then, the air pressure is increased and the throughput is increased. The processing condition of throughput of 4.0 gram per hole per minute and air pressure of 70 psig with the drawing unit positioned 25 cm from the spinneret and the forming table 40 cm below the slot is finally established. The web thus obtained has an excellent uniformity with filament size of 4.5 deniers. The filament spinning speed is 8,000 meters per minute.

EXAMPLE 4

As in Example 2 with 35 MFR polypropylene, when lower throughput is used, the non-woven web thus obtained has better uniformity with different filament sizes. For throughput of 1.0 gram per hole per minute, air pressure for the drawing unit is 45 psig and the drawing unit is 30 cm away from the spinneret, the web with filament size of 1.8 deniers is produced. For throughput of 0.5 gram per hole per minute, air pressure of 35 psig with drawing unit 30 cm below the spinneret, the web with filament size of 1.0 denier is produced. As the throughput is reduced to 0.1 gram per hole per minute at air pressure of 25 psig and the drawing unit 20 cm below the spinneret, an extremely uniform web with filament size of 0.25 deniers is obtained.

In one embodiment, during an initial startup, filaments are extruded through a spinneret in a form of downwardly vertically advancing curtain at nominal throughput and the drawing unit is positioned down from the spinneret with nominal air pressure and volume. With this setting, the filament curtain can be cooled down even by ambient air alone to avoid sticking among filaments before being sucked into the drawing unit. When spinline is fully established and stabilized, the drawing unit is moved up towards the spinneret gradually while increasing the pressure and volume of the air supply to the drawing unit and the polymer throughput. As the drawing unit is moved up closer to the spinneret and higher air pressure and volume are used, the temperature at which the filaments are being drawn and the drawing force on the filaments are correspondingly increased, resulting in filaments of smaller size. Reduction in filament size facilitates the cooling of filaments so that the drawing unit can be further moved up toward the spinneret without causing filaments sticking to each other before entering the drawing unit. By repeating those steps of alternatively adjusting the position of the drawing unit, the volume and pressure of the air supply and the throughput of the polymer melt, a desired production can be reached wherein the finest (smallest denier) filaments are produced at maximum throughput for the given process condition. While adjusting the processing condition as described above, the forming distance to web forming table may be adjusted accordingly to achieve the best uniformity of the resultant web. The as-formed web can then be subject to one of many conventional techniques for bonding or tangling to form the final spunbond fabric web, or wound up as it is without any further process, depending upon the end uses of the web.

Although certainly the start-up procedure described above is desirable for efficiently getting the spin line established and stabilized, once the optimum distance between the drawing unit and the spinneret, which establishes the filament distance, has been determined for a particular desired product throughput and denier, whether it be polypropylene, polyester, or other polymers, the machine can be set for a fixed distance from the spinneret to the drawing unit with other parameters such as the air pressure and the opening of the slot gap being variable so that a start-up wherein the spinneret and drawing unit are not moved together but are fixed, can be achieved by diligently and slowly feeding the filaments through the drawing slot in order to get the unit up to the desired throughput. It is also important to utilize a drawing unit wherein the total vertical slot distance from air nozzles to bottom opening, as described herein, does not exceed 210 mm and in fact is quite less. The objective is to achieve a greatly increased form drag beneath the drawing unit created by the filaments moving and wagging in the air streams exiting the bottom of the drawing unit slot which has sufficient energy to induce from drag that greatly increases the drawing force on the filaments. With reducing both the filament distance and the air resistance and increasing of the drawing force by intensive form drag, the velocity of the filaments is greatly increased.

Figure 4:
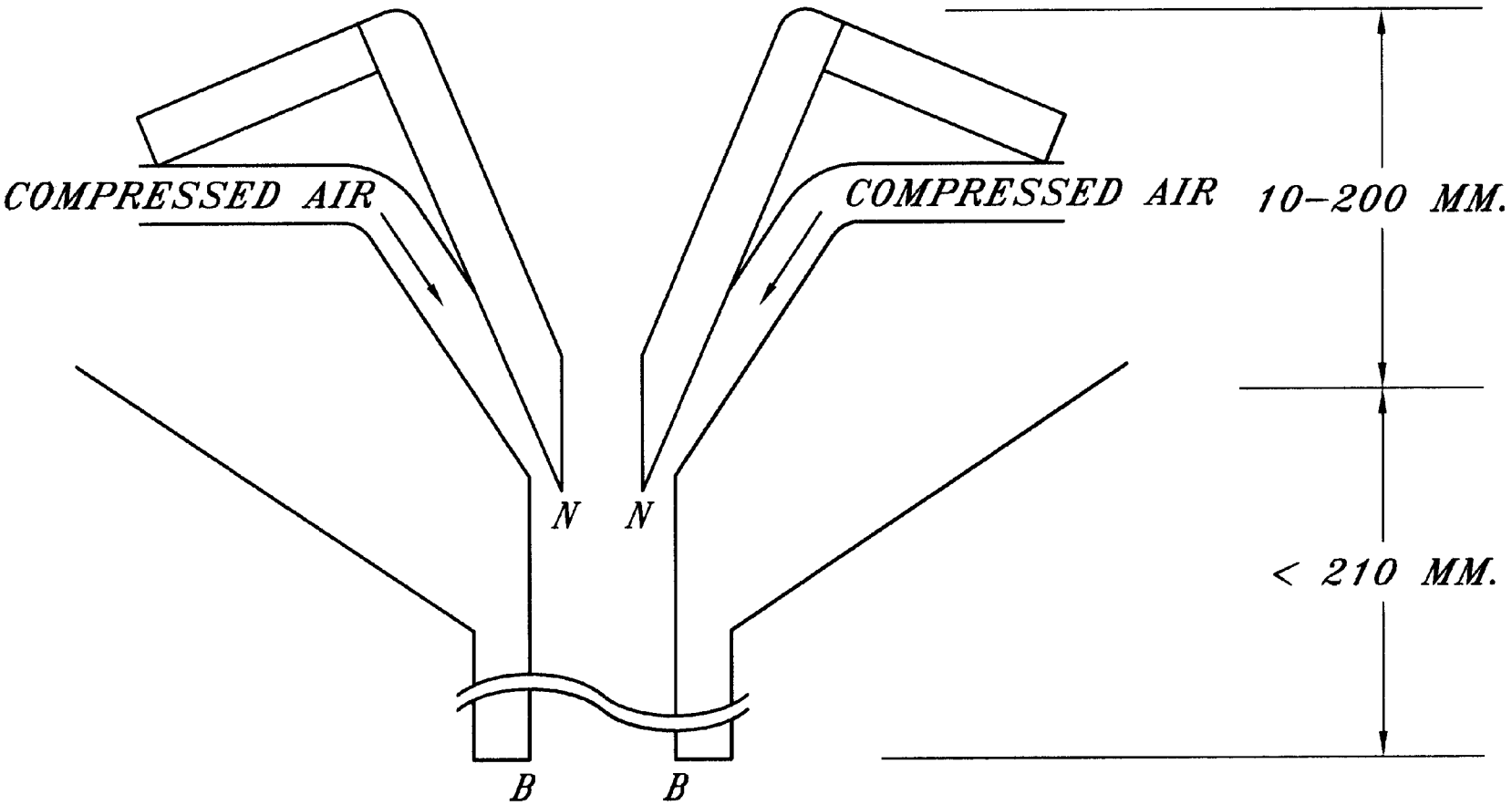
FIG. 4 shows a schematic diagram of a drawing unit slot in cross-section showing the present invention.
Figure 5:
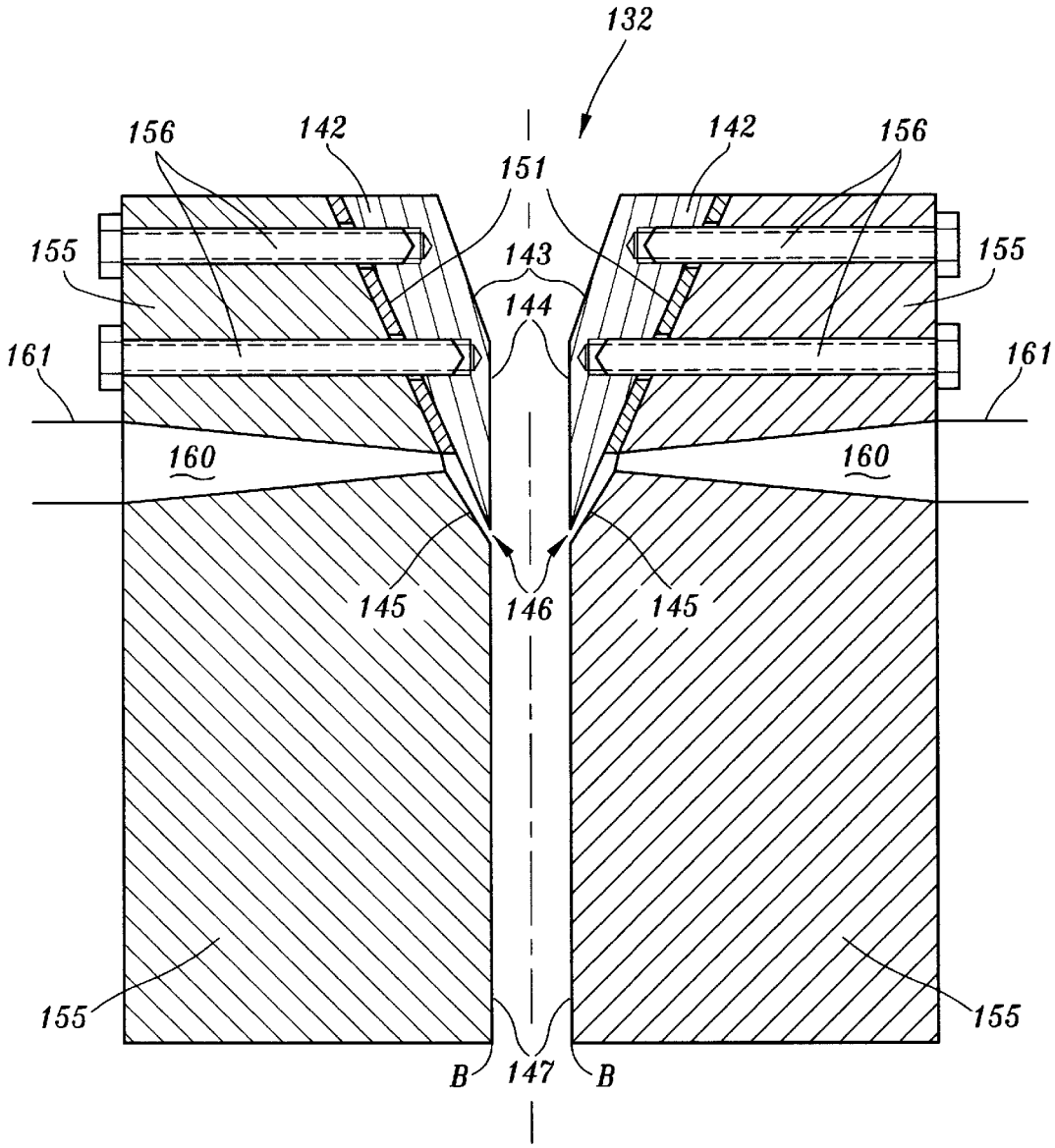
FIG. 5 shows a side elevational view and cross-section of the drawing unit in accordance with the present invention.
Figure 6:
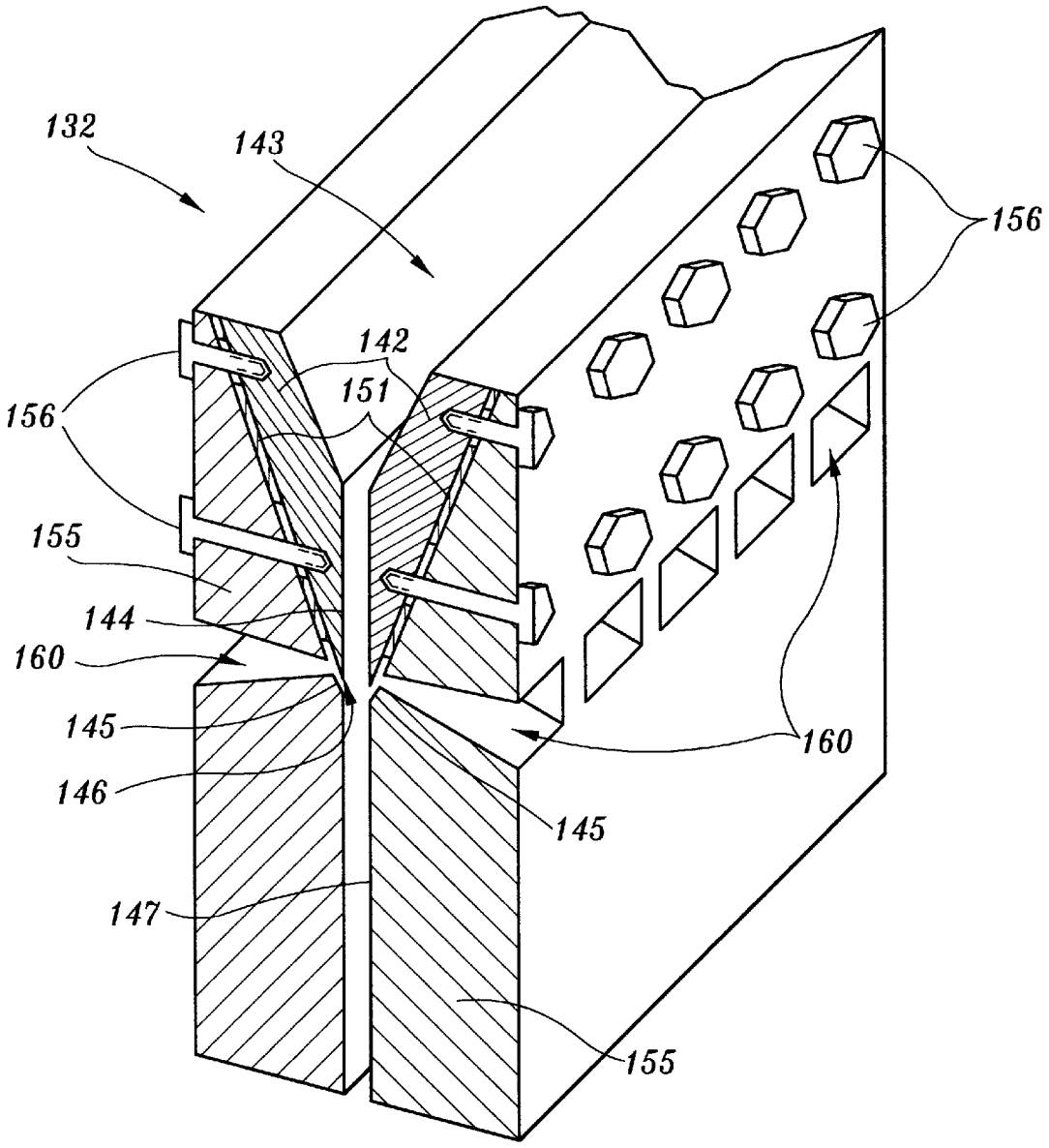
FIG. 6 shows a perspective view with an elevational cross-section of the drawing unit and slot in accordance with the present invention.

Referring now to FIGS. 4, 5 and 6, the drawing unit and the effect of the slot distance vertically is discussed because of its importance in the overall invention. By increasing the form drag on the filaments, the force for creating a high velocity filament is generated as part of the overall operation. Looking at FIG. 4, the overall concept is shown wherein in viewing the schematically represented slot in FIG. 4, it is shown that from the very top of the slot opening to the compressed nozzle openings N, distances may vary from 10 mm to 200 mm. Basically, the slot opening has a 45° or at least angular opening to allow the filaments to be received into the slot. FIG. 4 is not to scale but is for explanation purposes only. In the area designated N, which is where very high velocity compressed air exits all the way along the entire longitudinal and lateral length of the slot opening, the compressed air strikes the filaments forcing them downward by drag. From the nozzle openings N to the bottom of the slot B, Applicant has determined a distance of less than 210 mm is short enough so that the initial force on the compressed air exiting nozzle end will not be expended by the time the compressed air stream reaches the bottom slot opening B. Therefore, there will be sufficient energy left in the compressed air stream at position B to provide turbulent flow field on the filaments as they exit and proceed beyond the bottom of the slot B. This turbulence has found to cause the filaments to wave back and forth somewhat in an S-shaped fashion, which greatly increases and receives energy from the turbulent air creating a form drag or pushing force on the filaments resulting in a net force that increases the velocity of the filaments through the whole process from the spinneret down. Wherein for conventional drawing units the goal is to eliminate the air turbulence, Applicant has found that using the turbulence in the form of form drag actually increases the velocity of the filaments resulting in the numerous benefits described herein including the rate of stressed-induced crystallization of the filaments which solidify at a higher temperature resulting in filaments of higher tensile strength and higher quality. This is all achieved while greatly increasing the throughput because of increased filament velocity.

Referring now to FIG. 5, a drawing unit is shown at cross-section to further describe the improved slot relationship within the drawing unit. The drawing unit 132 is shown that includes the air knife 142 having upper open top slot segment 143 on a converging opening to the upper slot segment 144. The drawing unit has a lower slot segment 147 terminating in the bottom slot opening.

The body of the drawing unit is formed by body 155, which is a heavy block of material. Air supplied to the drawing unit through air channels 160 on each side of the drawing unit which include polished surfaces 145 terminating in air nozzles 146 formed by the air knife 142 in conjunction with the polished surface of the unit body 145 on each side.

The air knives 142 on each side can be adjusted by bolts 156 to change the nozzle openings 146 through adjustment relative with shims 151 that provide spacing between the air knives 142 and the drawing unit bodies 155.

The upper slot opening 143 has an angle with the vertical line of 10°–40° or more and the vertical length ranges from 1–10 cm or more.

The upper slot portion 144 is a filament traveling channel and has a length of typically less than 15 cm.

The air nozzles 146 each communicate with the slot at an angle with the center line from 10°–30 or more. The air gap of each nozzle 146 varies within a range of 0.05–3 mm which is controlled by shims 151 and adjusting bolts 156.

One of the critical distances is the distance between the nozzles 146 vertically and the bottom of lower slot segment 147, shown as the letter B which should be less than 21 cm from the tips of the nozzle to the exit B of the slot. The distance between the opposing walls of the slot is in a range from 1–30 mm from side-to-side along the entire longitudinal length of the drawing unit.

Numeral 161 shows on each side an air supply pipe to air channels 160.

By controlling the vertical length for nozzles 146 to lower slot opening B, the force of air exiting at B continues to be high enough to create turbulence, and therefore, large form drag on the filaments as they exit lower slot 147 at B.

FIG. 6 shows a drawing unit in perspective that has a longitudinal length that can be selected depending on the nature of the job to be done in conjunction with a description of the slot provided herein.

The preferred embodiment includes having the drawing unit separated from the spinneret between 5 cm and 90 cm for fine denier and up to 150 cm for coarse denier to achieve low air resistance on the filaments to increase velocity during normal production. Filaments of 0.1 to 2.5 deniers or higher for polypropylene at a production rate of 70 to 360 kilograms or higher per meter of machine width per beam per hour and 0.1 to 4.5 or higher deniers for polyethylene terephthalate at a production rate of 100 to 540 kilograms or higher per meter of machine width per beam per hour can be produced. The preferred embodiment further includes a web forming table which is capable of being adjusted both horizontally and vertically in accordance with positions of the spinneret and the drawing unit to achieve a uniform non-woven web which may then be bonded by one of many known techniques to produce the final spunbond fabric webs.

Figure 7:
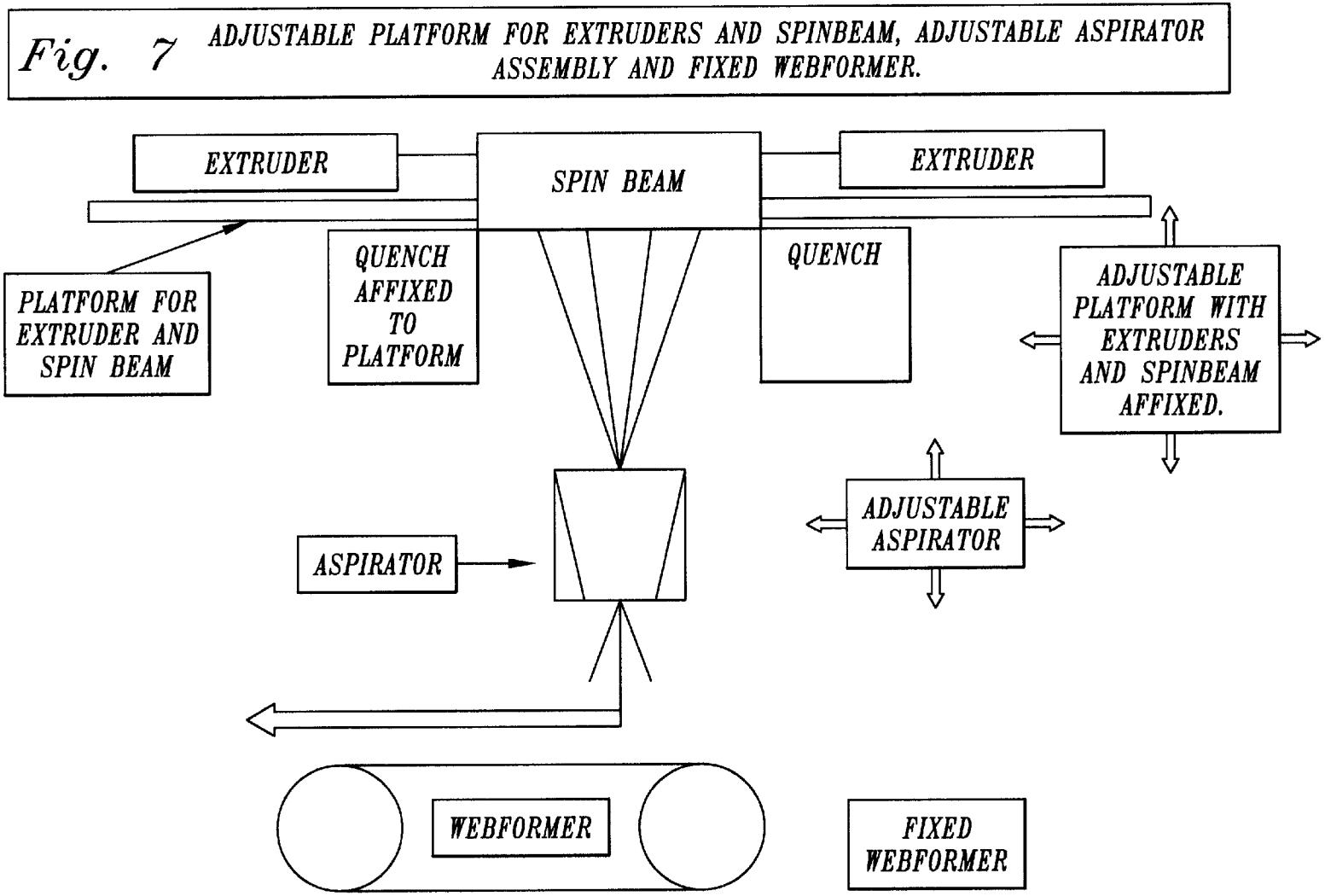
FIG. 7 shows a schematic diagram of the relationship between the extruder, the spinneret (spin beam), the drawing unit or aspirator and the web-forming platform or the web-former.

Referring now to FIG. 7, a schematic diagram shows the adjustable platform for extruders in spin beam, an adjustable aspirator or drawing unit assembly and a fixed web-forming platform, which in this case is a continuous moving horizontal belt that receives the filaments for forming the web. In the embodiment shown in FIG. 7, the web-former is fixed as to its vertical and horizontal location with respect to the drawing unit or aspirator and the spinneret or spin beam. The drawing unit or aspirator is adjustable vertically and horizontally relative to the fixed web-former and relative to the spin beam.

The extruder and spin beam and quench are all affixed to an adjustable platform in which the extruder, spin beam and quench box are fixed together, but the entire platform is adjustable vertically relative to an adjustable aspirator and the fixed web-former. Therefore in the embodiment shown in FIG. 7, the drawing unit or aspirator can be moved relative to the fixed web-former and relative to the platform that includes the spin beam. Also, the platform containing the spin beam and extruders can be moved relative to the aspirator and relative to the fixed web-former.

Figure 8:
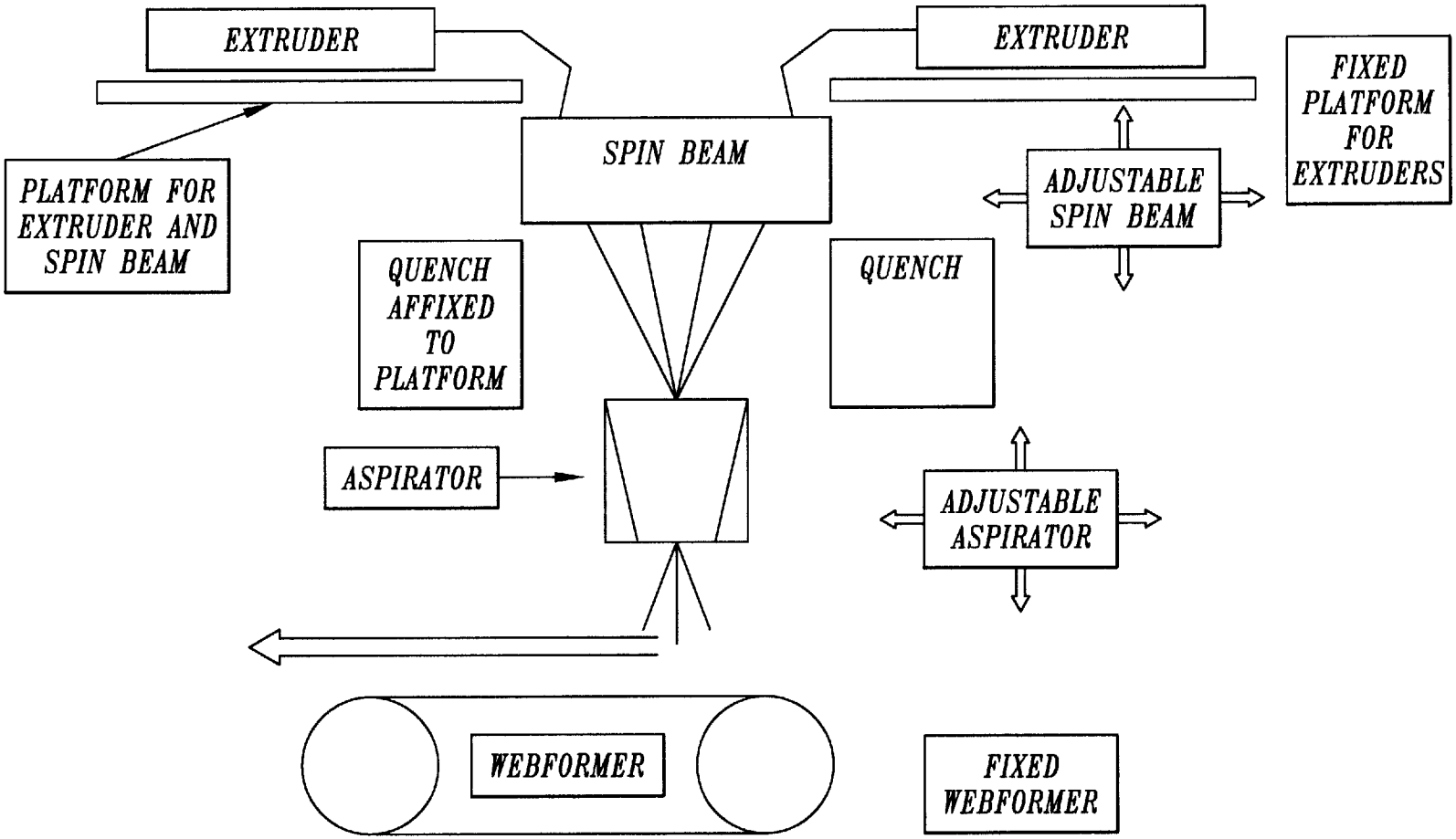
FIG. 8 shows an alternate embodiment of the device shown in FIG. 7 in a schematic diagram in relationship to the location and moveability of the extruder, the spin beam, the aspirator and the web-former.

Referring now to FIG. 8, the machine includes a fixed platform for the extruders that are fixed in space. The spin beam or spinneret can be adjustable vertically relative to the fixed platform containing the extruders. The web-former is fixed vertically and includes an endless belt or a platform that moves horizontally around a pair of rollers as a continuous endless belt for forming the spunbond product. As shown in FIG. 8, the aspirator or drawing unit is moveable vertically and horizontally relative to the fixed web-former and relative to the spinneret or spin beam. The quench box is affixed to the spin beam. Thus, for adjustment purposes, the spin beam is adjustable vertically and the aspirator is adjustable vertically and relative to each other, while the platform with the extruder is fixed and the web-former is fixed vertically.

Figure 9:
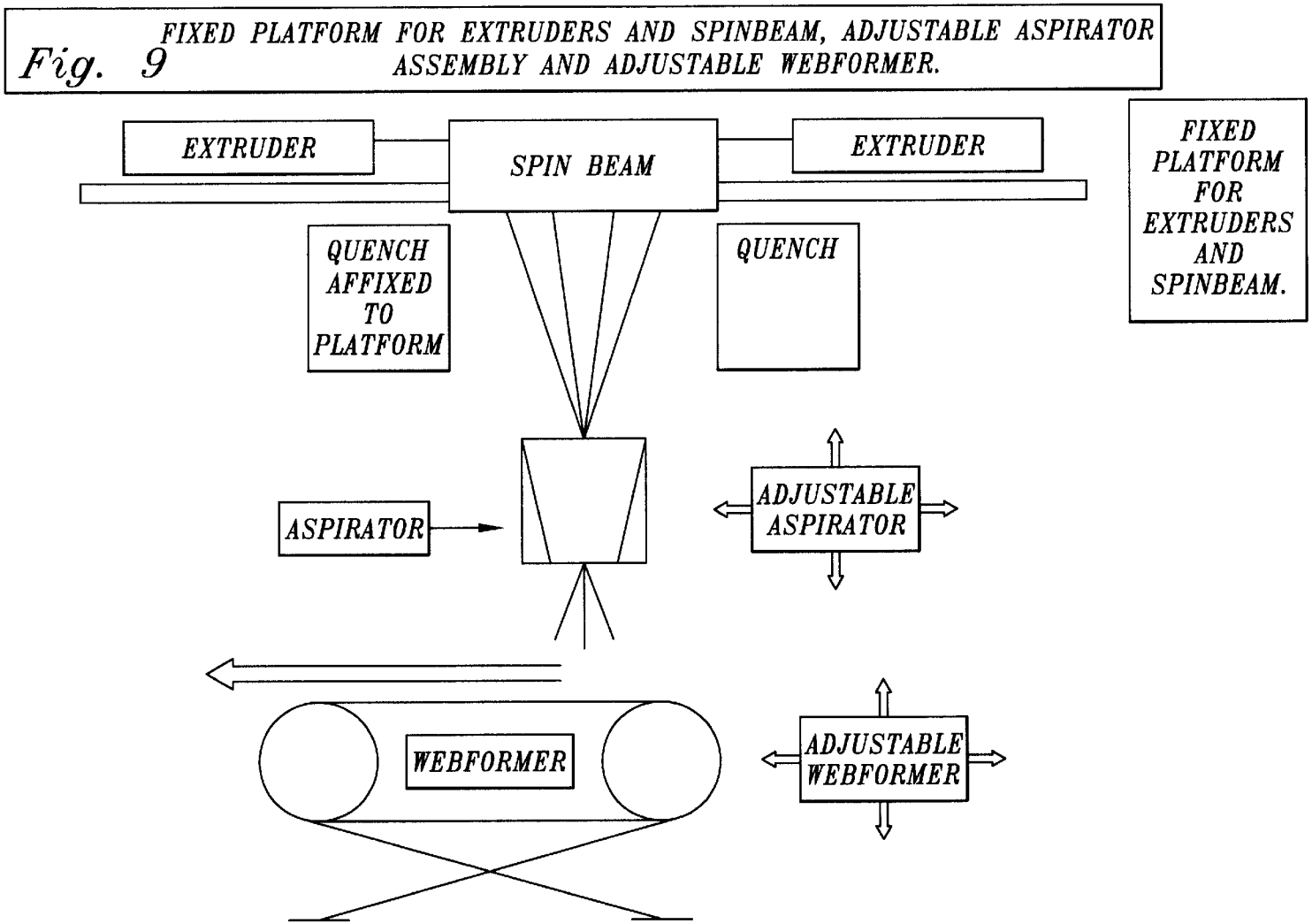
FIG. 9 shows yet another alternate embodiment in a schematic diagram of the relationship between the extruders, the spin beam, the aspirator and the web-former with respect to adjustability.

Referring now to FIG. 9, another alternate embodiment between the extruder, the spin beam, the aspirator and the web-former is shown. A platform containing the extruder and the spin beam is fixed vertically and horizontally in space. A quench box is affixed to the platform. Therefore, the extruder, the spin beam and the quench box do not move vertically or horizontally.

The aspirator or drawing unit is adjustable vertically relative to the spin beam and relative to the web-former, which itself is also adjustable vertically. The vertically-adjustable web-former also includes the horizontally-moving endless belt for receiving the filaments for forming the spunbond product which is driven-around a pair of separated rollers. The entire platform is thus adjustable vertically for the web-former. Therefore, in order to adjust the distance between the drawing unit and the web-former, the spin beam or spinneret remains fixed in space while the aspirator can be moved vertically and horizontally relative to the spin beam as can the web-former be moved vertically and horizontally relative to the aspirator and to the spin beam.

The embodiment shown in FIG. 7 is the preferred embodiment, but obviously, the embodiment shown in FIGS. 8 and 9 could also be used.

Thus, it is apparent that the present invention has provided an apparatus and a process for producing spunbond non-woven webs that fully satisfies the objects, aims, and advantages set forth above.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for forming a non-woven web from extruded polymer filaments, comprising:

polymer extruding means including melt spinning means, having a spinneret with a plurality of multiple rows of closely spaced orifices, for extruding a plurality of continuous polymeric filaments;

filament drawing means including slot walls forming a longitudinally disposed elongated slot positioned strategically below said spinneret at a predetermined distance between 5 cm and 150 cm for producing a predetermined low air drag on said filaments to increase the net filament drawing force resulting in a high filament velocity and low denier filament;

air nozzle means for supplying air under pressure, said nozzle means mounted on at least one slot wall and having an outlet communicating with said drawing means elongated slot along substantially the entire longitudinal length of said drawing unit slot, said air nozzle means being oriented for introducing a downwardly directed stream of air, to create a first drawing force within said slot and a second drawing force below said slot created by form drag on said filaments to increase filament velocity, said low air drag produced on said filaments between said spinneret and said drawing means and said second drawing force on said filaments after said filaments exit said drawing slot producing a net drawing force on said filaments that results in a high filament velocity; and web forming means positioned below said drawing unit slot for collecting the filaments for formation into a non-woven fabric web.

2. An apparatus for forming a non-woven web as in claim 1, including water spray means positioned adjacent to and surrounding the spinneret for cooling said filaments.

3. An apparatus for forming a non-woven web as in claim 1, including means for movably adjusting the distance between said spinneret and said drawing unit, whereby the distances between the spinneret and the drawing unit can be adjusted.

4. An apparatus for forming a non-woven web as in claim 2, wherein said water spray means includes a water pipe adjacent to and surrounding said spinneret with water heads downwardly installed, spaced strategically apart at predetermined distances from each other.

5. An apparatus for forming a non-woven web as in claim 1, including said nozzle means including positioning of said nozzle means adjacent to said slot and positioned relative to said slot to form a turbulent flow along and below the vertical length of said slot for exerting said first and second drawing force on the filaments as the filaments are entrained vertically within and through said slot in said drawing means, said nozzle means also producing said second drawing force as form drag on said filaments producing a pattern of "flapping" or "waving" motion of said filaments below said slot resulting in an enlarged net drawing force on said filaments to produce high filament velocity.

6. An apparatus for forming a non-woven web as in claim 1, wherein the distance between said spinneret and said drawing unit is between 5 and 150 cm to produce filaments of 0.1 to 20 or higher deniers for polypropylene at a production rate of 70 to 360 kilograms or higher per meter of machine width per beam per hour and for polyethylene terephthalate at a production rate of 100 to 540 kilograms or higher per meters of machine width per beam per hour.

7. An apparatus for forming a non-woven web as in claim 3, wherein said means for positioning said drawing unit relative to said web forming means includes at least one male screw vertically attached to said drawing unit and said web forming means and including a matching female screw attached to said drawing unit and motor means attached to said male screw for moving said drawing unit relative to said web forming means.

8. A process for forming a spunbond, non-woven polymeric fabric from a plurality of polymeric extruded filaments, comprising the steps of:

(a) extruding a plurality of filaments by melt spinning through a spinneret from a thermoplastic polymer;

(b) drawing said filaments by a drawing means positioned below said spinneret using air pressure, applying said drawing force at a predetermined distance between 5 cm and 150 cm from said spinneret, said predetermined distance between said spinneret and said drawing means chosen to produce an air drag force having a magnitude which produces a filament velocity in the range of 3500 meters/minute to 8000 meters/minute or more on said filaments; and (b1) creating low air drag on said filaments to produce a high filament velocity based on the reduced air drag on the filaments resulting from the predetermined distance between the spinneret and the drawing means; and (c) forming a web on a web forming means positioned below said drawing means, whereby the denier size of the filaments and the net drawing force on the filaments can be controlled by the distance between the drawing means and the spinneret.

9. A process as described in claim 8, including the step of adjusting the distance between the spinneret and the drawing means between 5 and 150 cm.

10. A plurality of filaments forming a spunbond, non-woven fabric web, produced by the process comprising the steps of:

(a) extruding a plurality of filaments by melt spinning through a spinneret from a thermoplastic polymer;

(b) drawing said filaments with a drawing force by a drawing means positioned below said spinneret using air pressure, applying said drawing force at a predetermined distance between 5 cm and 150 cm from said spinneret selected to produce low air drag on said filaments, said drawing force combined with said air drag having a magnitude which produces a filament velocity in the range of 3000 meters/minute to 8000 or more meters/minute filament velocity; and (c) forming a web on a web forming means positioned below said drawing means, whereby the denier size of the filaments can be controlled by the distance between the drawing means and the spinneret.

11. A plurality of filaments as in claim 10, having a denier of 0.1–2.5 for polypropylene and 0.3–4.5 for polyester.

12. A process to increase filament velocity while forming a spunbond, non-woven, polymeric fabric from a plurality of polymeric extruded filaments comprising the steps of:

extruding a plurality of filaments by melt-spinning through a spinneret from a thermoplastic polymer;

drawing the filaments with a first drawing force created on said filaments within a drawing slot by a high velocity stream of air and a second drawing force created by form drag on said filaments below said drawing unit slot;

producing a net spin line force balance on said filaments by providing a distance from the drawing slot to the spinneret to reduce the air drag above said drawing slot, said spin line force combined with said first drawing force and said second drawing force to produce high velocity filaments; and positioning a web forming means below said drawing unit slot for collecting the filaments and forming the filaments into a non-woven web.

13. The process as in claim 12 including the steps of:

producing an increased filament birefringence by selecting a distance between the spinneret and the drawing means to reduce air drag on said filaments to produce a particular fiber and fabric tensile strength resulting from the increased net drawing force on said filaments producing high filament velocity.

14. The process as in claim 12 including the steps of:

providing a distance between the spinneret and the drawing means to increase the temperature at which the on-line crystallization of the filaments occurs due to the effect of stress induced crystallization, resulting in filaments being spun at higher temperature and lower viscosity to readily achieve higher filament velocity.

15. A process for forming a spunbond, non-woven, polymeric fabric from a plurality of polymeric extruded filaments spun at high velocity comprising the steps of:

extruding a plurality of strategically oriented filaments from a thermoplastic polymer by melt-spinning through a spinneret;

drawing said filaments by a net drawing force generated by a drawing means positioned at a predetermined distance from said spinneret to provide low air drag and high filament velocity, said drawing means providing internal air pressure within said drawing means and high velocity air below said drawing means creating a net drawing force on said filaments; and selecting the distance between said spinneret and said drawing means to reduce the air drag force on said filaments to increase the net drawing force on said filaments to increase filament velocity; and forming a filament web of a spunbond, non-woven polymeric fabric by depositing said extruded filaments on a web forming means positioned at a pre-selected distance below said drawing unit.

16. A process for forming a spunbond non-woven, polymeric fabric from a plurality of polymeric extruded filaments for providing high filament speed comprising the steps of:

extruding a plurality of filaments from a thermoplastic polymer by melt-spinning through a spinneret;

drawing said filaments with a drawing force by a drawing means positioned at a preselected distance from said spinneret, said preselected distance chosen to reduce air drag on said filaments to increase the net drawing force on said filaments;

selecting the distance between the spinneret and the drawing means to produce an air drag force on the filament spin line having a magnitude which produces a filament speed in the range of 3000 meters per minute to 8000 or more meters per minute for increasing throughput and filament tensile strength and for increasing the net drawing force on the filaments to increase filament velocity; and forming a filament web of a spunbond, non-woven polymeric fabric by depositing said extruded filaments on a web forming means positioned below said drawing means.

17. A process as in claim 16 including the steps of:

providing the distance between the spinneret and the drawing means between 5 centimeters and 150 centimeters to produce a particular desired filament denier with high filament velocity.

18. An apparatus for forming a non-woven web from extruded polymer filaments comprising:

a polymer extruder including melt spinning component having a spinneret with one or more rows of closely spaced orifices for extruding a plurality of continuous polymeric filaments;

a drawing unit including a longitudinally disposed elongated slot positioned below said spinneret along substantially the entire longitudinal length of said drawing unit;

one or more air nozzles for supplying high velocity streams of air, said air nozzle(s) having an outlet communicating with said drawing unit elongated slot along substantially the longitudinal length of said drawing unit, said air nozzle being disposed to provide high velocity streams of air in at least one predetermined direction downwardly within said slot for introducing downwardly directed streams of air into said slot, said drawing unit slot including a bottom opening, the distance between said air nozzle and said bottom of said drawing unit slot opening being less than 210 mm to allow air generated at high velocity within said drawing unit to exit said drawing unit slot bottom opening to provide additional force on said filaments after said filaments leave said drawing unit; and web-forming platform positioned below said drawing unit for collecting the filaments for formation into a non-woven fabric web, whereby high velocity air exiting said drawing unit slot bottom opening interacts with said filaments exiting said drawing unit bottom slot causing said filaments to wave in a waving pattern below said slot bottom opening creating a downward force on said filaments thereby increasing the drawing force on said filaments.

19. A process to provide high velocity filaments while forming a spunbond, non-woven, polymeric fabric from a plurality of polymeric extruded filaments comprising the steps of:

(a) extruding a plurality of filaments by melt-spinning through a spinneret from a thermoplastic polymer;

(b) drawing the filaments with a net drawing force created by a combination of a first drawing force created by a first air stream generated by high velocity air directed on filaments within a drawing unit slot and a second drawing force created by form drag on said filaments beneath the drawing unit slot resulting from high velocity air exiting the drawing unit slot bottom, said form drag creating a waving pattern of filaments beneath the drawing unit slot increasing the downward force on said filaments;

(c) reducing the air drag on said filaments above said drawing unit by providing a predetermined distance between said spinneret and said drawing unit to produce high velocity filaments during the spunbond operation;

(d) collecting said filaments on a web forming means below said drawing unit.

20. A process for forming a spunbond, non-woven web from extruded polymer filaments comprising the steps of:

(a) extruding a plurality of filaments by melt spinning through a spinneret from a thermoplastic polymer;

(b) drawing said filaments by a drawing means positioned a predetermined distance from said spinneret producing low air drag on said filaments;

(c) producing a predetermined filament velocity in the range of 3000 meters/minute to 8,000 or more meters/minute by creating a net drawing force on said filaments by producing low air drag on said filaments between said spinneret and said drawing means;

(d) creating a first drawing force on said filaments within said drawing means slot; and creating a second drawing force on said filaments below said drawing means slot, the combination of said low air drag, and said first and second drawing forces producing said predetermined filament velocity; and (e) collecting the filaments on a web forming means for formation into a non-woven fabric web.

21. A process as in claim 20 including the steps of:

(f) said second drawing force creating a filament flapping and waving below the drawing means generating form drag on said filaments to produce a high net drawing force on said filaments to provide a predetermined high filament velocity.

* * * * *